US005769240A

United States Patent [19]

Middour et al.

[11] Patent Number: 5,769,240

[45] Date of Patent: Jun. 23, 1998

[54] SCREENING SYSTEMS AND METHODS FOR SCREENING PARTICULATE MATERIAL

[75] Inventors: Paul H. Middour, Albuquerque, N. Mex.; Frederick W. Oldenburg, Mesa, Ariz.; Cletus E. Riedel, Cedar Crest; Thomas E. Teeter, Los Lunas, both of N. Mex.

[73] Assignee: Western Wire Works, Inc., Portland, Oreg.

[21] Appl. No.: 540,744

[22] Filed: Oct. 11, 1995

[51] Int. Cl.[6] ..... B07B 1/28

[52] U.S. Cl. ..... 209/314; 209/395; 209/412

[58] Field of Search ..... 209/313, 314, 209/315, 394, 395, 396, 403, 405, 412

[56] References Cited

U.S. PATENT DOCUMENTS

| | | | |
|---|---|---|---|
| 3,221,877 | 12/1965 | De Koning | 209/314 |
| 3,241,671 | 3/1966 | Brauchla | 209/314 X |
| 3,454,162 | 7/1969 | Cover | 209/314 X |
| 5,219,078 | 6/1993 | Hadden | 209/314 X |
| 5,322,170 | 6/1994 | Hadden | 209/314 |

FOREIGN PATENT DOCUMENTS

| | | | |
|---|---|---|---|
| A-631825 | 6/1993 | European Pat. Off. . | |
| A-1322014 | 5/1970 | United Kingdom . | |
| 2134415 | 8/1984 | United Kingdom | 209/314 |
| A-2233582 | 7/1990 | United Kingdom . | |
| A-2247850 | 8/1991 | United Kingdom . | |

*Primary Examiner*—D. Glenn Dayoan
*Attorney, Agent, or Firm*—Marger Johnson McCollom & Stolowitz, P.C.

[57] ABSTRACT

A screening system, preferably a finger screening system, for screening particulate material is provided. The subject screen system includes (a) a screening assembly including horizontally-extending support members located within the confines of the assembly; (b) a plurality of screening modules mounted to the support members and located within the confines of the screening assembly, each screening module having a support block having a plurality of rods joined at a first end to the support block, the second end of the rods being free of attachment, to form a row of the rods arranged substantially parallel to each other and extending outwardly from the support block, the row of rods defining an array of sieve openings of a predetermined size for allowing particulate material up to a predetermined size to pass through the screening module; (c) a plurality of attachment assemblies for removably joining the plurality of screening modules to the support frame; and (d) a plurality of fasteners for connecting the support blocks to the support frame.

31 Claims, 6 Drawing Sheets

SCREENING SYSTEMS AND METHODS FOR SCREENING PARTICULATE MATERIAL

BACKGROUND OF THE INVENTION

The invention relates to systems and methods for screening particulate material, and more particularly to finger screening systems for screening particulate material.

Screening is the separation of aggregate particles into various sizes. Various conventional types of screens are used to separate aggregate including vibrating inclined, stationery inclined, vibrating grissly, vibrating horizontal, rotary and static.

The vibrating inclined screen is the most popular of the screen types. Types of vibrating screens include those with two and four bearings, high speed screens, and screens which vibrate at the natural frequency of selected spring clusters. The majority of aggregate producers utilize a two or three deck included vibrating screen with two bearings. The two bearing, circle throw, inclined screen utilizes a counter weight on a shaft to move the screen through approximately a ⅜ inch displacement throw. Screen throw varies inversely with the shaft speed with typical ranges from 800 to 950 rpm. The screen is isolated on springs and is customarily powered by an electric motor with a V-belt drive. Screen slopes vary from 15 to 30 for dry separations to slightly flatter for wet sieving.

The included vibrating screen is angularly adjustable to an inclined position to improved efficiency. Variations in slope, speed, stroke, and direction of rotation provide the flexibility required to determine the best combination of variables for making the separation. The inclined vibrating screen is typically used for aggregate separation. The addition of extra counterweights allow the screen to handle dense, coarse aggregate. When properly sized, the inclined vibrating screen performs virtually maintenance-free except for wear from the aggregate as it is processed. Horizontal screens are normally selected when conserving headroom or there is a need to maintain a lower profile. Variations in speed and stroke can be made for a given separation scheme.

The screening surface used in combination with a given vibrating screen must be strong enough to support the weight of the material, flexible enough to withstand the vibration, and provide enough open area to allow the desired throughput of aggregate. Various screening decks and screening elements are known for this purpose. One type of screening system particularly useful for applications typically plagued by binding problems, i.e., clogged screen surfaces from sizing materials with a high percentage of soil, roots, vines, plastic, demolition materials, etc., is a finger screening system. The particular types of problem screening materials which finger screening systems are designed to handle include topsoil, landfill material, recycling waste, compost, sand and gravel, and demolition debris.

One known type of finger screening system is the Erin Matech Cascade apparatus manufactured and sold by Buffalo Wire Works Co., Inc. of Buffalo, N.Y. This system includes replaceable rods made of high carbon steel of differing diameter (depending on the desired diameter and slot opening requirements) which are inserted into a row of apertures, having a complimentary diameter to the diameter of the rods, located in one side of an elongate rectangular polyethylene rod block. The elongate rod block is compressibly retained within an U-shaped elongate channel defined by an elongate metal U-shaped channel member. Once in place, the channel member surrounds a substantial area at the side of the rod block. A plurality of U-shaped channel members, each containing elongate rod blocks with rods located in the apertures, are pivotally attached to a metal frame member system. In this way, the angle that the channel members, and in turn the rod block, and further in turn the row of horizontal rods, forms with the frame member, can be adjustably set.

The metal frame member system is designed to attach to the interior support members of a vibrating screen box. The vibrating screening boxes comprise a pair of vertically-extending sidewall members disposed in a vertical position in a parallel vertical plane. The rear vertically-extending edges of the sidewall members are joined one to the other by a vertically-extending rearwall member. The vibrating screening boxes are also held together by interior metal support members joined to the sidewalls and rearwall thereof. The metal frame member system including the rods and rod blocks which are non-integral but are instead designed to attach to the metal support frame members. Once the metal frame system, including the rod block and the rods, are in place attached to the interior of the vibrating screen box, the screening process can be conducted.

The above-described finger screen system has a number of drawbacks. The metal frame member must be individually fabricated for vibrating screen boxes of differing shapes and dimensions, and for structural support members of differing configurations. This is a problem since some vibratory screen boxes have laterally-extending support members and some have longitudinally-extending support members. It is also a costly problem for end user who must stock differing frame members for all of its vibratory screen boxes of differing shapes and dimensions. Also, replacement of metal frame members is time consuming both in the assembly of the frame members themselves and in their attachment to the screening vibratory box support structure. Moreover, individual rod block and rod assemblies cannot be removed without disassembly of the U-shaped metal frame member from within the vibratory screen box. This results in an inordinate amount of production downtime. Finally, the use of metal frame members causes several further problems. On the one hand, they suffer from a substantial wear problem which results from the flow of the aggregate material during the screening process. On the other hand, the metal frame members are not strong enough to permit their use over open spans greater than about five feet.

Accordingly, the need remains for a system which permits the effective and efficient replacement of screening system, which provides for low cost, fast, convenient and nondestructive replacement of finger screens within the confines of the vibratory screening box, which substantially reduces the wear problems associated with the prior art metal frame members, and which can be used on screening assemblies having open spans greater than about 5 feet.

SUMMARY OF THE INVENTION

The above-described needs have been met by the method and system of the present invention which comprises an effective and efficient means for screening particulate materials typically plagued by plugging problems.

The method and system of the present invention provides for fast, convenient and low cost installation and replacement of finger screens for screening particulate material on a vibrating or static screening assembly. The subject system includes an integral screening module designed for direct attachment to and removal from the screening assembly without the need to detach or disassemble the support structure (to which the screening modules are attached) from the screening assembly. Thus, screening modules can be readily removed and replaced without expending substantial downtime in completing system maintenance.

In the system of this invention the amount of metal, and in turn the weight of the system, is significantly reduced. This allows a user to design a system in which open spans of greater than 5 feet can be employed.

The configuration of the subject system is such that mounting supports are not substantially within the flow path of the particulate material. This significantly eliminates the above-described wear problems since the wear-resistant screening modules, and not metal support members, are located within the flow path of the particulate material during the screening operation. Stated another way, the system of this invention utilizes more of the existing machine support structure, and requires less auxiliary support structure, than the above-described prior art apparatus.

The subject invention relates to a screening system, preferably a finger screening system, for screening particulate material. The system comprises a screening assembly, which is preferably a vibrating screening assembly, but can also be a static system, which includes a housing defining an interior screening chamber and horizontally-extending mounting supports located within the confines of the interior screen chamber. The horizontally-extending mounting supports are designed for connection to the existing framework located within the housing of the screening assembly. These horizontally-extending mounting supports structurally maintain a plurality of screening modules attached thereto for performing the screening functions described herein. The screening assembly has a longitudinally-extending axis and a laterally-extending axis. As opposed to a number of conventional finger screen systems, the support structure of the screen assembly in the present invention can have either a crowned or uncrowned configuration.

A plurality of screening modules are mounted to the mounting supports within the interior screening chamber. Each screening module comprises a support block defining a plurality of first attachment apertures and a plurality of rods joined at a first end to the support block. The support block is typically fabricated of a rigid polymeric material, preferably a rigid polyurethane material. In any case, the second end of the rods is free of attachment. A row of rods, arranged substantially parallel to each other, extend outwardly from the support block. The row of rods define an array of continuous sieve openings of a predetermined width for allowing particulate material of up to a predetermined width to pass through the screening module. Preferably, the free end of a rod is arranged in a fixed, non-adjustable position at a point above the end of the rod joined to the rod block, thereby further facilitating the screening of the particle material. The rods are preferably straight but can also be crimped to form a wavy, bent or pinched configuration.

The rods can be structurally reinforced by tying together adjacent rods using connecting ties such as wires or the like. These connecting ties extend across the sieve openings and are joined at their respective ends to a pair of adjacent rods. The connecting ties and rods together define an array of discontinuous sieve openings of a predetermined width and length for allowing particulate material of up to a predetermined width and length to pass through the screening module.

The elongate support blocks are laterally-extending and preferably comprise respective front, rear, top and bottom elongate surfaces. When the elongate support blocks are attached to the mounting supports they are typically arranged in a fixed, nonadjustable position. Preferably, when the bottom elongate surface of the elongate support block is disposed in a horizontal plane, the upper edge of the elongate front surface is at a point above the upper edge of the elongate rear surface. In this way, the free ends of the rods are at a point higher than the end of the rods joined to the support block so that the screening is further facilitated due to the tumbling action of the particle material.

In another preferred embodiment of the this invention, the support block can be strengthened by including structural reinforcement as part of the support block arrangement. Thus, the support block can further include an auxiliary internal stiffening member, such as a rigid plate or the like, for maintaining the structural integrity of the support block. The structural configuration of this invention preferably excludes metal components such as structural support members, which have a higher wear rate, from being within the particulate material flow path. Instead, the material flow path is substantially limited only to the support blocks which are typically fabricated of a material which has a much a higher wear resistance level. The auxiliary stiffening member defines a plurality of openings which are in vertical alignment with the first and second attachment apertures.

A plurality of attachment assemblies are also provided for removably joining the plurality of screening modules to the screening assembly. Each attachment assembly comprises elongate connector strips. The elongate connector strips define a plurality of second attachment apertures located within the elongate connector strips. The second attachment apertures are in vertical alignment with the first attachment apertures in the support block. This allows a fastener to pass therethrough for connecting the support blocks to the elongate connector strips and in turn attaching the screening modules to the mounting support. A plurality of fasteners are located within the first and second attachment apertures for connecting the support blocks to the mounting support. Preferably, the fasteners comprise bolts each including an elongate straight shaft and a U-shaped end section. A portion of the straight shaft is disposed within the first and second attachment apertures and a portion of the U-shaped end section is connected to the screening assembly.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
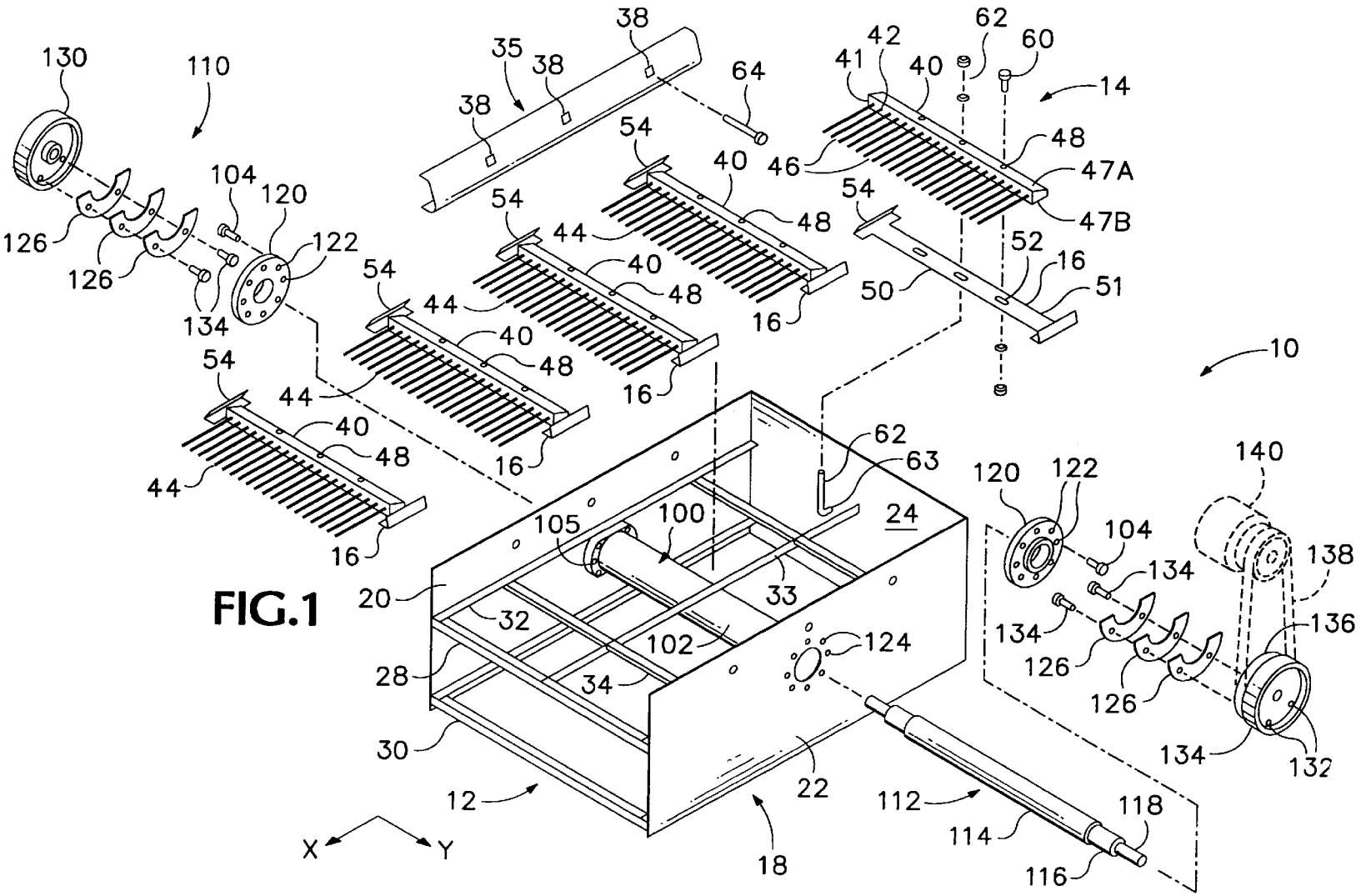
FIG. 1 is a perspective, exploded view of a first screening system of the present invention designed for attachment to a first vibrating screening assembly, including a perspective, exploded view of an eccentric mechanism for producing a vibrating action.

Referring now to FIG. 1, a finger screening system denoted "10", comprises a vibrating screen assembly, denoted generally "12", screening modules 14, and attachment assemblies 16, respectively. Vibrating screen assembly 12 comprises a longitudinal axis extending in the direction of the arrows denoted "X", and a lateral axis extending in the direction of the arrows denoted "Y". The vibrating screen assembly 12 includes longitudinally-extending clamp rails 35. The attachment assemblies 16 are specifically designed for attachment to the longitudinally-extending crown bar 33 of vibrating screen assembly 12.

The vibrating screen assembly 12 depicted in FIG. 1 comprises first and second longitudinally-extending elongate sidewalls 20 and 22 which are vertically arranged and substantially parallel to each other, and laterally-extending elongate rear wall 24 which is vertically arranged and is substantially perpendicular to sidewalls 20 and 22. One end of each of the first and second sidewalls 20 and 22 is joined to the respective ends of rear wall 24 to define a rectangularly-shaped housing 18 therewithin. First and second sidewalls 20 and 22 and rear wall 24 typically comprise elongate flat metal plates and are joined together by conventional welding or mechanical fastening techniques.

The structural integrity of vibrating screen assembly 12 is reinforced by attaching a pair of structural mounting support to the inter surfaces of first and second sidewalls 20 and 22 and rear wall 24 within housing 18. More specifically, the structural mounting support depicted herein includes an upper structural mounting support 28 and a lower structural mounting support 30. More specifically, upper and lower structural mounting supports 28 and 30 comprise longitudinally-extending structural members 32 and laterally extending structural mounting supports 34 which are joined one to the other and also to the inner surface of first and second sidewalls 20 and 22 and rear wall 24. Additionally, the upper structural support frame 28 includes longitudinally-extending crown bar 33 which is attached at one end to the inner surface of rear wall 24 and at the other end and at an intermediate point to laterally-extending structural mounting supports 34.

A system "100" for vibrating the screening modules 14 is depicted in FIG. 1. System 100 comprises an eccentric drive shaft housing 102 which is joined by fasteners 104 to sidewalls 20 and 22. A conventional eccentric mechanism 110 is housed within the confines of eccentric drive shaft housing 102. This eccentric mechanism typically comprises a central drive shaft 112 having a central section 114, an intermediate section 116, and an end section 118. Section 116 is of a narrower diameter than section 114, and section 118 is of a narrower diameter than section 116. Furthermore, short end sections 118 are of a narrower diameter than intermediate sections 116, and intermediate sections 116 are of a narrower diameter than long central section 114. A pair of bearing housing flange assemblies 120, having a plurality of ball bearings contained therein, are mounted onto short intermediate sections 116. The bearing housing flange assemblies 120 include a plurality of apertures 122, which are patterned to align with corresponding apertures 124 located in sidewalls 20 and 22, are attached to sidewalls 20 and 22 and to housing 120 by fasteners 104. Eccentric counterweights 126, with apertures 128 located therewithin, are mounted on intermediate sections 116, and are offset to provide eccentric vibration for screen module 14. The balance wheels 130 and 134 include apertures 132, which are patterned to align with corresponding apertures 128 located in counterweights 126, the balance wheels 130 and 134, and the counterweights 126, are connected to each other by set screws 134. The balance wheel 134 includes a driven sheave 136 about which a pulley belt 138 is connected, the pulley belt 138 also being disposed about a drive motor 140 for providing rotary power to the eccentric mechanism.

The longitudinally-extending clamp rails 35 of finger screening system 10 define a series of openings 38. These opening 38 receive clamp rail fasteners 64 for attaching clamp rails 35 to first and second sidewalls 20 and 22.

Figure 7:
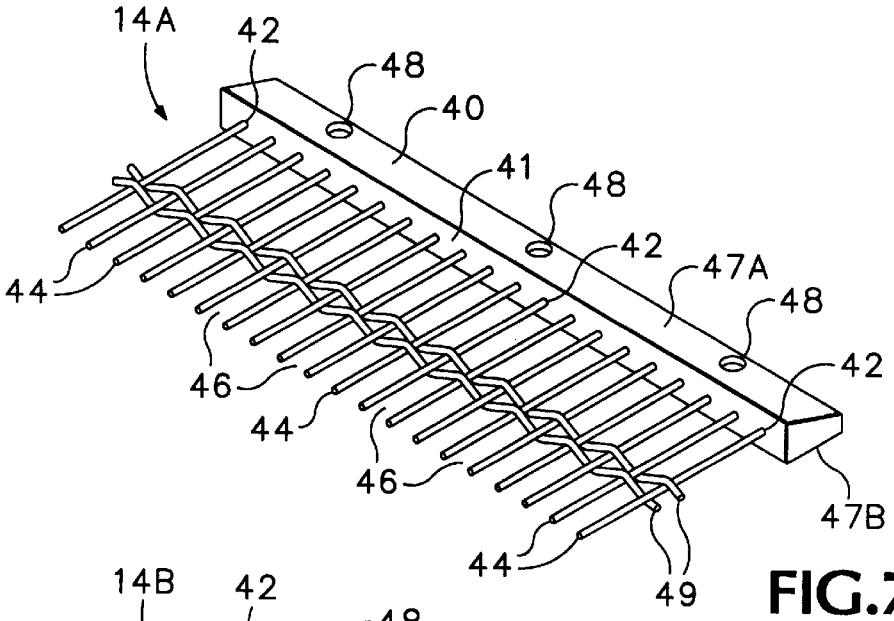
FIG. 7 is an enlarged, perspective view of a screening module 14 comprising elongate support block 40 and a plurality of cylindrical rods 44 joined together by connecting ties 49.
Figure 8:
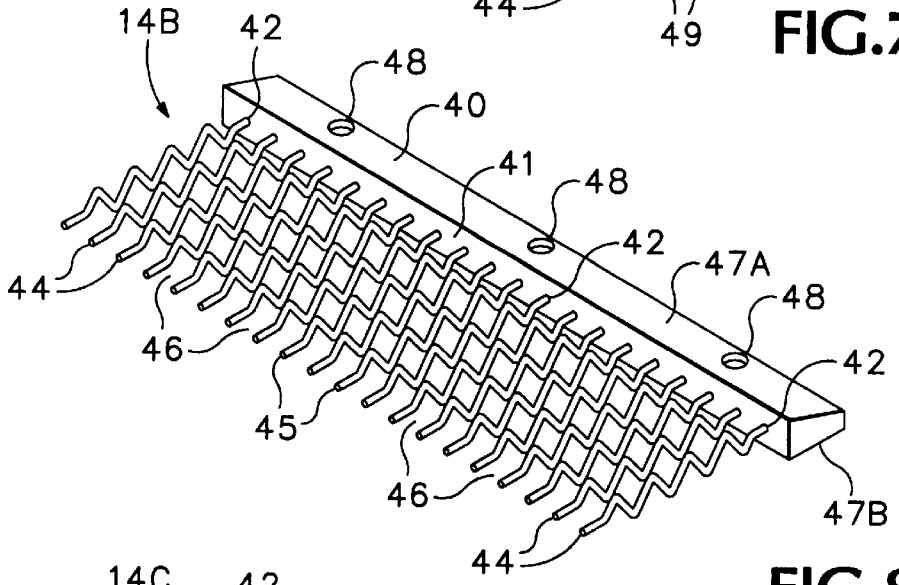
FIG. 8 is an enlarged, perspective view of a screening module 14 comprising elongate support block 40 and a plurality of crimped cylindrical rods 45.
Figure 9:
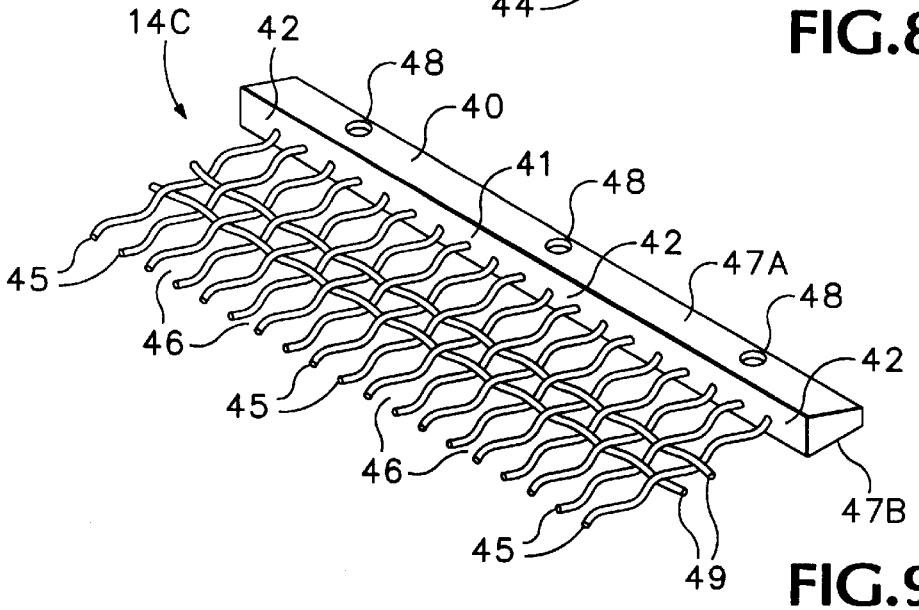
FIG. 9 is an enlarged, perspective view of a screening module 14 comprising elongate support block 40 and a plurality of crimped cylindrical rods 45 joined together by connecting ties 49.

System 10 is employed for screening particulate matter according to size employing screen modules 14 (see FIG. 1), and screen modules 14*a*–14*c* (see FIGS. 7–9). Modules 14 and 14*a*–14*c* comprise elongate support blocks 40 which are fabricated typically of a nonmetallic material, preferably a polymeric material, and more preferably a rigid polymeric material such as a polyurethane material. The front face 41 of support block 40 defines a plurality of holes 42 arranged in a substantially horizontal, laterally-extending row. One end of a plurality of cylindrical rods 44 (see FIGS. 1 and 7) is attached within the holes 42 to form a row of laterally-extending rods arranged in a horizontal plane and extending outwardly from front face 41 of the support block 40. As previously stated, the rods 44 can be crimped, "denoted 45", to form a wavy (see FIG. 8), bent (see FIG. 9) or pinched configuration (not shown). The row of rods 44 or 45 define an array of sieve openings 46 of a predetermined size for allowing particulate matter of up to a predetermined size to pass through the screening module 14. A plurality of first attachment apertures 48 extend in a substantially vertical plane from the respective top and bottom horizontal faces 47*a* and 47*b* of support block 40. These first attachment apertures 48 are employed for inserting hereinafter described fasteners 60 and in turn to directly attach screening modules 14 to the vibrating screen assembly 12.

As previously stated, the longitudinally-extending rods 44 or 45 can be structurally reinforced by tying together adjacent rods using laterally-extending connecting ties 49, typically in form of wires or the like, which extend across and interweave through and can be joined to the row of rods. These connecting ties extend across the continuous sieve openings 46. The connecting ties 49 and rods 44 or 45 together define an array of discontinuous sieve openings of a predetermined width and length for allowing particulate material of up to a predetermined width and length to pass through the screening module.

Finger screening system 10 also includes attachment assemblies 16 for removably joining the screening modules 14 to vibrating screening assembly 12. Each attachment assembly 16 comprises a connector strip member 50 comprising a rectangular strip portion 51 defining a plurality of second attachment apertures 52. Connector strip portion 51 has a pair of substantially parallel flanged ends 54 which are complementary to, and are designed for attaching connector strip member 50 to, longitudinally-extending clamp rails 35. In a typical arrangement of the attachment assemblies 16, the lateral spacing between adjacent screening modules 14 can be determined by setting the lateral dimension of the flanged ends 54.

Figure 3:
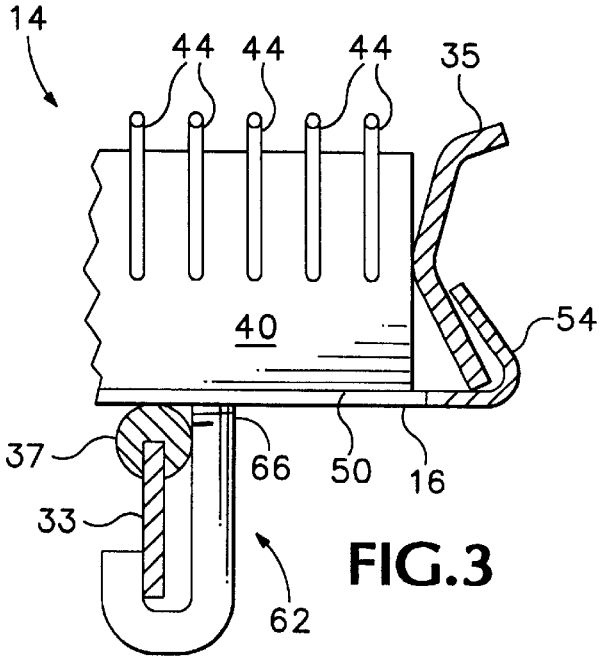
FIG. 3 is an enlarged, front, fragmentary sectional view of a screening module and connector strip of the present invention which is shown as attached to a longitudinally-extending clamp rail and a longitudinally-extending crown bar of the screening assembly of FIG. 1.
Figure 4:
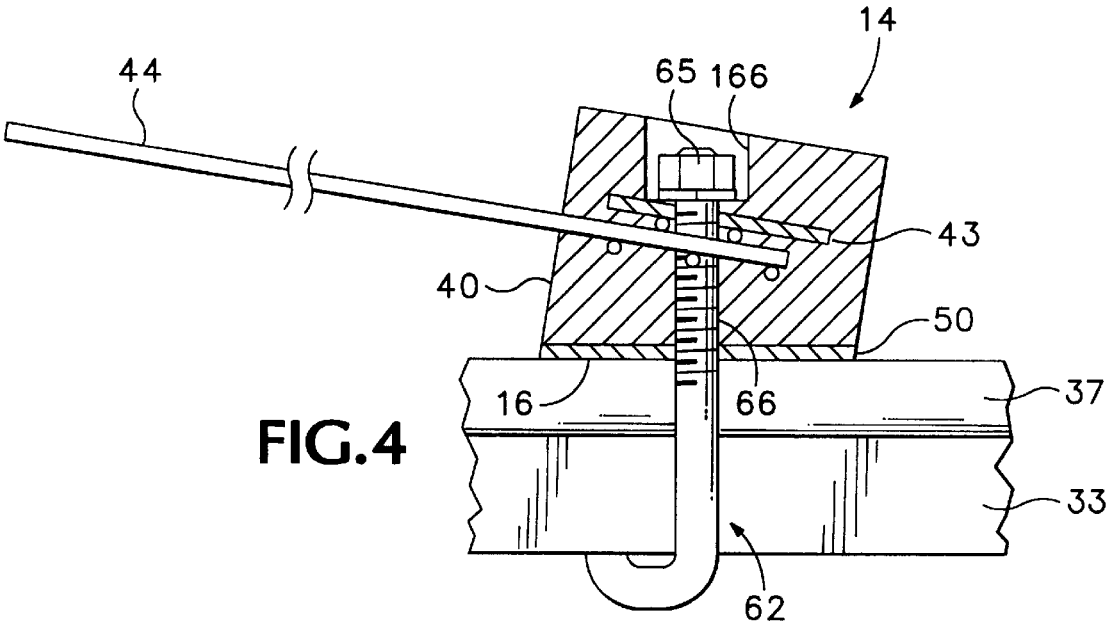
FIG. 4 is an enlarged, side, sectional view of the screening module and connector strip of FIG. 3.

Screen modules fasteners 60 are provided for joining together screening modules 14 and attachment assembly 16. This is accomplished by inserting the fasteners 60 into first and second attachment apertures 48 and 52, and then connecting screen module fasteners 60 to vibrating screen assembly 12. Furthermore, to further facilitate the connection of the screening module 14 to the vibrating screen assembly 12, a J-bolt fastener 62 comprising a U-shaped lower section 63 is disposed within first and second apertures 48 and 52 and about longitudinally-extending crown bar 33. The attachment of screening module 14 to longitudinally-extending crown bar 33, and in turn to vibratory screening assembly 12, is more specifically depicted in FIGS. 3 and 4. In FIG. 3, for example, screening module 14 is attached to crown bar 33, and is held in position with respect vibratory screen assembly 12 by J-bolt fastener 62 comprising a including an elongate straight shaft 66 attached at one end to a U-shaped end section 63, which extends about the lower portion of longitudinally-extending crown bar 33, and includes a threaded end section 66 at the other end. A nut and washer assembly 65 is connected about threaded end section 66 to retain J-bolt fastener 62 in place. Flanged ends 54 engage and connect to longitudinally-extending clamp rails 35. It should also be noted that the lower face of connector strip 50 is designed to rest on crown bar rubber protective strip 37. Regarding FIG. 4, J-bolt head 65 is shown to be located in recessed area 49 of support block 40. J-bolt fastener 62 is also secured in position within recessed area 49 by reinforcing plate 43 which also serves to maintain the structural integrity of support block 40.

Figure 2:
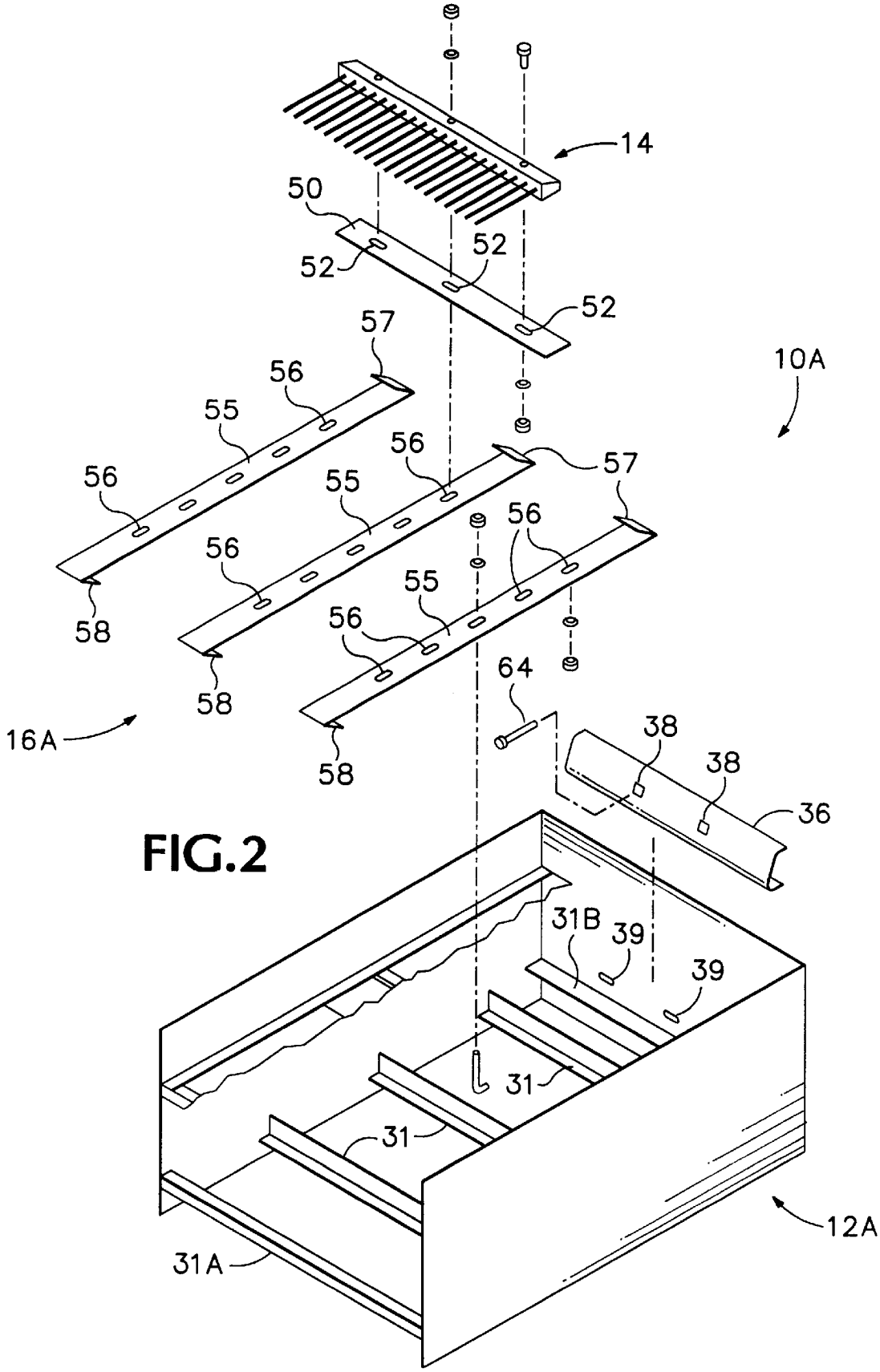
FIG. 2 is a perspective, exploded view of a second screening system of the present invention designed for attachment to a second vibrating screening assembly.

Referring now to FIG. 2, finger screening system 10*a* a second design form of the finger screening system of the present invention. More particularly, finger screening system 10a is similar in construction to finger screening system 10 of FIG. 1 except that it comprises lower laterally-extending support members 31, and a laterally-extending clamp rail 36 instead of longitudinally-extending clamp rail 35 or draw bar (not shown), which is attached to rear wall 24 and to support ledge 31*a* and to end bar 31*b* by clamp rail fasteners 64 passing through openings 38 in clamp rails 36 and being held in place by nut and washer assembly 65 (not shown). For purposes of this invention, other commercially available tensioning assembly which can be employed instead of the laterally-extending clamp rail 36 are any one of the following: an angle member or a ledge or an end support or a rectangular tensioning bar. In order to facilitate attachment of the screening module vibratory screening system 12*a*, attachment assembly 16*a* is provided which comprises a laterally-extending connector strip 50 defining second attachment apertures 52 and longitudinally-extending connector strips 55 which define third attachment apertures 56. Connector strips 55 also include upwardly-extending flanged end 57 and downwardly-extending flanged end 58, which are complementary to, and are designed for attaching connector strip member 52 to, longitudinally-extending clamp rails 36 and end support 31*b*.

Figure 6:
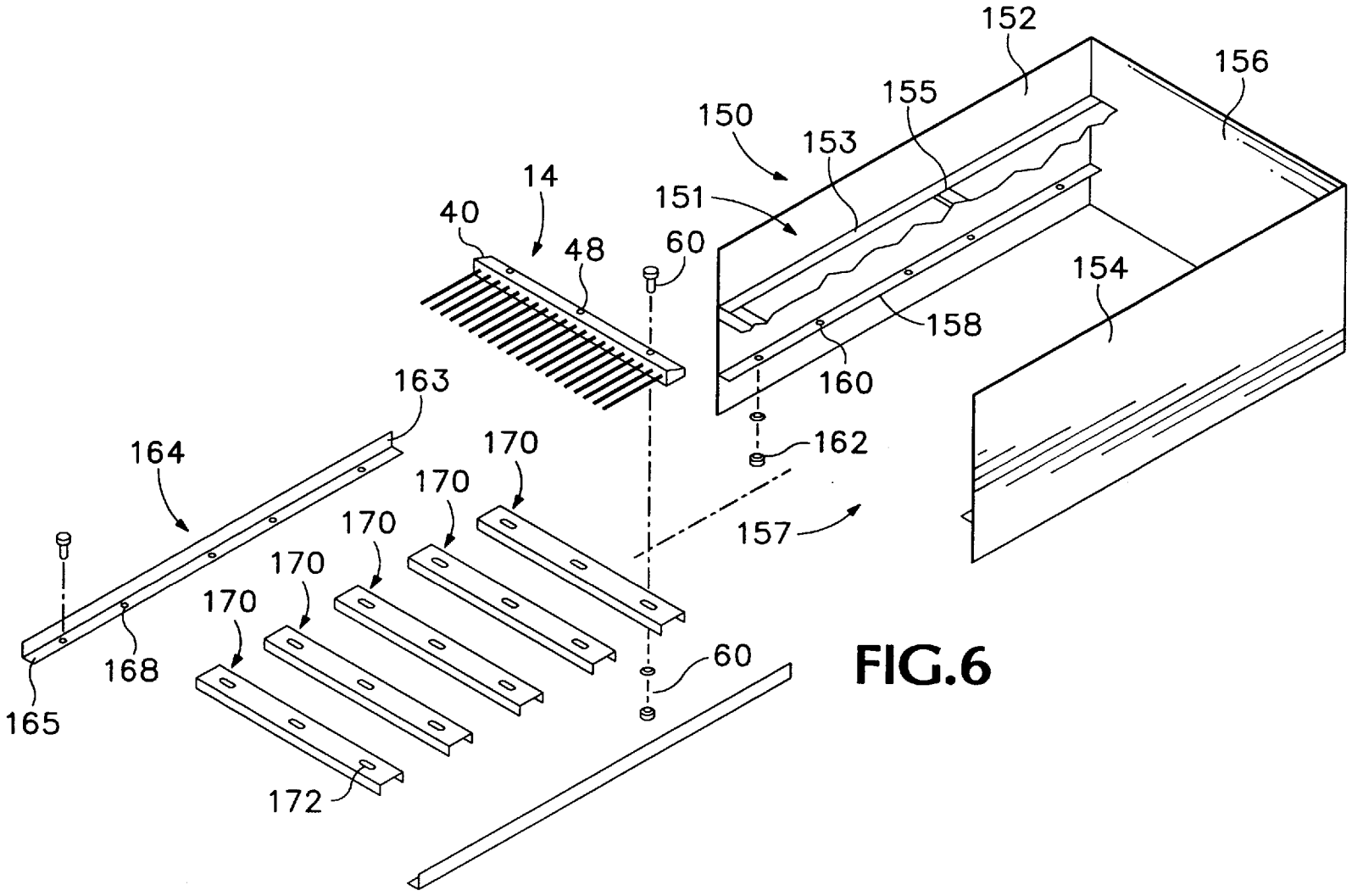
FIG. 6 is a perspective, exploded view of a screening system of the present invention attached to a third vibrating screening assembly.

The vibrating screen assembly 150 depicted in FIG. 6 comprises first and second longitudinally-extending elongate sidewalls 152 and 154 which are vertically arranged and substantially parallel to each other, and laterally-extending elongate rear wall 156 which is vertically arranged and is substantially perpendicular to sidewalls 152 and 154. One end of each of the first and second sidewalls 152 and 154 is joined to the respective ends of rear wall 156 to define a rectangularly-shaped housing 157 therewithin. First and second sidewalls 152 and 154 and rear wall 156 typically comprise elongate flat metal plates and are joined together by conventional welding or mechanical fastening techniques.

The structural integrity of vibrating screen assembly 150 is reinforced by attaching a pair of structural mounting supports 151 to the inter surfaces of first and second sidewalls 152 and 154 and rear wall 156 within housing 157. More specifically, the structural mounting support 151 depicted herein includes longitudinally-extending structural mounting supports 153 and laterally-extending structural mounting supports 155. A pair of longitudinally-extending support rims 158 are attached to the inner surface of the sidewalls 152 and 154. The support rims 158 have a plurality of apertures 160 located therewithin in predetermined points along the supports rims. A pair of side angles 164, comprising a vertical section 163 and a horizontal section 165 joined a right angles one to the other, each have a plurality of apertures 168 located within in predetermined points along the horizontal section 165 are joined together. The side angles 164 are attached onto the support rims 158 by a fastener 162 which attaches through apertures 160 and 168 which are aligned with each other. A plurality of laterally-extending, rectangular structural support members 170, each having a plurality of apertures 160 located therewithin in predetermined points along the support members 170, are joined at their respective ends to side angles 164. The laterally-extending, rectangular structural support members 170 include a plurality of apertures 172 located in predetermined points along the support members 170. Apertures 172 are aligned with apertures 48 of support block 40 so that fasteners 60 can be inserted therewithin for connecting screening module 14 to support member 170, and in turn to screen assembly 150. The screen assembly 150 is vibrated using an eccentric mechanism (not shown) similar to one described in FIG. 1 above.

Figure 5:
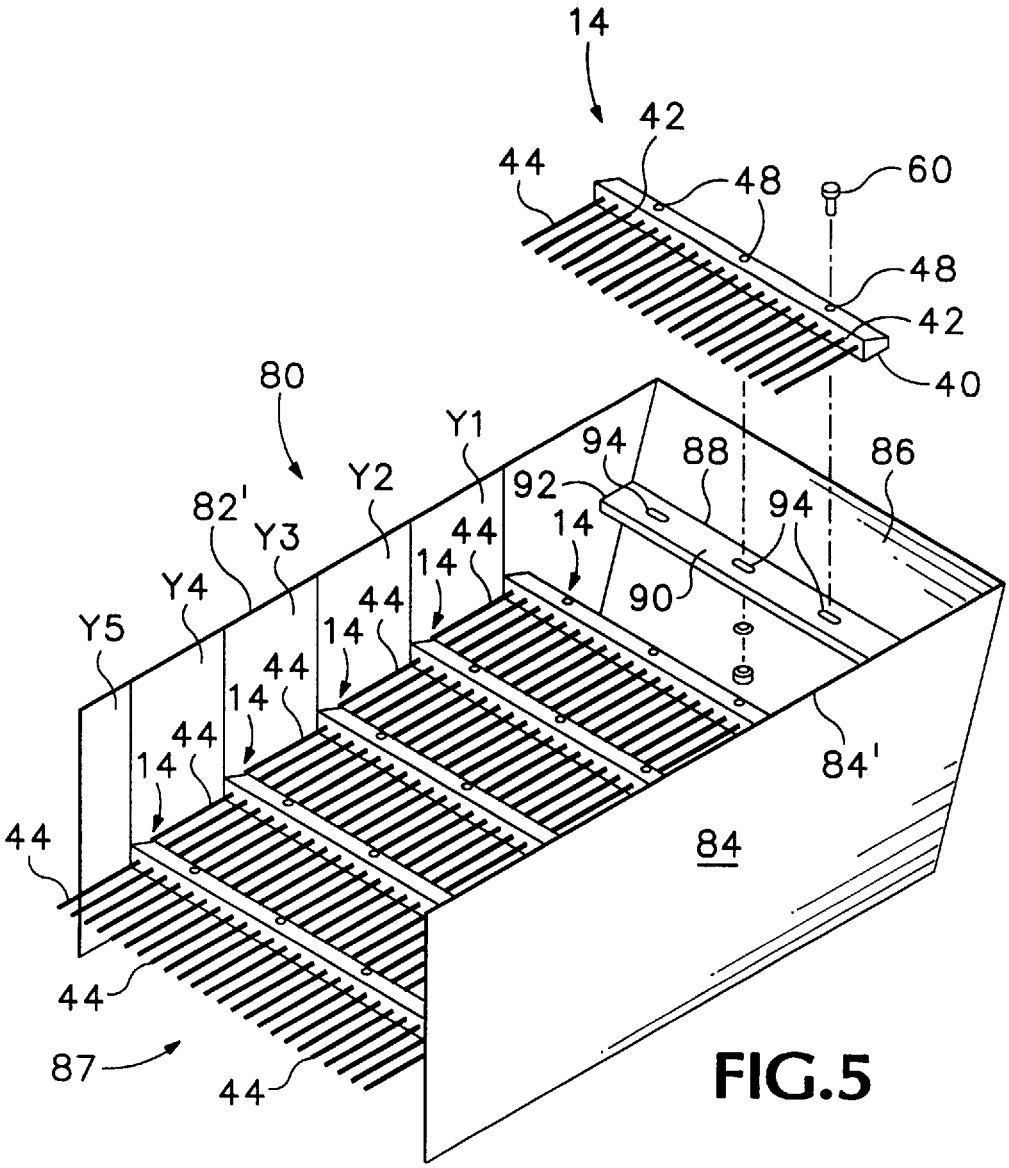
FIG. 5 is a perspective, exploded view of a screening system of the present invention attached to a first static screening assembly.

The screen assembly 80 depicted in FIG. 5 is a static screening system in which the particulate material fed to thereto is move by gravity along a downwardly-descending set of screen modules without being assisted by the vibrating action of the screens depicted in FIGS. 1, 2 and 6. Screen assembly 80 comprises first and second longitudinally-extending elongate sidewalls 82 and 84 which are vertically arranged and substantially parallel to each other, and laterally-extending elongate rear wall 86 which is vertically arranged and is substantially perpendicular to sidewalls 82 and 84. One end of each of the first and second sidewalls 82 and 84 is joined to the respective ends of rear wall 86 to define a rectangularly-shaped housing 87 therewithin. First and second sidewalls 82 and 84 and rear wall 86 typically comprise elongate flat metal plates and are joined together by conventional welding or mechanical fastening techniques.

A plurality of laterally-extending, rectangular structural support members 88, each having a plurality of apertures 94 located therewithin in predetermined points along the support members 88, are joined at their respective ends to sidewalls 82 and 84. The laterally-extending, rectangular structural support members 88 include a plurality of apertures 94 located in predetermined points along the support members 88. Apertures 94 are aligned with apertures 48 of support block 40 so that fasteners 60 can be inserted therewithin for connecting screening module 14 to screen assembly 80. In order to create a downwardly-descending set of screen modules extending from the rear to the front of screen assembly 80, screening modules 14 are joined to the inner vertical surface of sidewalls 82 and 84 at variable distances $Y_1$ through $Y_5$ from the top edge 82' and 84' of sidewalls 82 and 84, respectively. More specifically, the distance $Y_1$ is less than $Y_2$, which in turn is less than $Y_3$, which in turn is less than $Y_4$, which is turn is less than $Y_5$. Therefore, particulate material entering the screening assembly 80 will flow by gravity from the rearwall 86 toward the front allowing material of less then a predetermined size to pass between the rods 44 of screening modules 14.

Having illustrated and described the principles of my invention in a preferred embodiment thereof, it should be readily apparent to those skilled in the art that the invention can be modified in arrangement and detail without departing from such principals. I claim all modifications coming within the spirit and scope of the accompanying claims.

We claim:

1. A finger screening system for screening particulate material comprising:

a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, the second end of the rods being free of attachment, to form a row of the rods arranged substantially parallel to each other and extending outwardly from the support block, the row of rods defining an array of sieve openings of a predetermined size for allowing particulate material up to a predetermined size to pass through the screening module, the second end of each rod in each row, when said screening modules are in a stationary position, being arranged in a fixed position at a point above the first end of the rods, thereby facilitating screening of the particulate material;

a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly; and a plurality of fasteners located within the first and second attachment apertures and connecting the support blocks to the elongate connector strips and the screening modules to the screening assembly.

2. A screening system according to claim 1, wherein the second end of the rods is arranged in a non-adjustable position at a point above the first end of the rods.

3. A screening system according to claim 1, wherein the elongate support blocks are laterally-extending and comprise an elongate front and rear surface and, when said elongate support blocks are attached to said support frame, the elongate front surface is arranged in a fixed, non-adjustable position at a point above the elongate rear surface, and the second end of the rods is arranged at a point above the first end of the rods, thereby facilitating screening of the particle material.

4. A screening system according to claim 1, wherein said support block further includes a reinforcing member for maintaining the structural integrity of the support block, said reinforcing member defining a plurality of openings which are in vertical alignment with said first and second attachment apertures.

5. A screening system according to claim 1, wherein said fastener includes an elongate straight shaft and a U-shaped end section, the straight shaft being disposed within the first and second attachment apertures and the U-shaped end section connected about the support frame.

6. A screening system according to claim 1, wherein said support members are not located within the flow path of the particulate material during the screening operation.

7. A screening system according to claim 1, wherein a plurality of connecting ties extending across the sieve openings and joined at their respective ends to a pair of adjacent rods for tying together said adjacent rods, the connecting ties and rods together defining a plurality of slots for screening particulate material.

8. A finger screening apparatus for use in combination with a screen assembly to form a finger screen system, said screen assembly including a housing defining an interior screening chamber and a horizontally-extending frame located within the confines of said interior screen chamber and joined to the housing for supporting a plurality of screening modules attached to said horizontally-extending frame, said screening assembly having a longitudinally-extending axis and a laterally-extending axis, the finger screening apparatus comprising:

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, the second end of the rods being free of attachment, to form a row of the rods arranged substantially parallel to each other and extending outwardly from the support block, the row of rods defining an array of continuous sieve openings of a predetermined size for allowing particulate material up to a predetermined size to pass through the screening module, the second end of each rod in each row, when said screening modules are in a stationary position, being arranged in a fixed position at a point above the first end of the rods, thereby facilitating screening of the particulate material; and a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly; and a plurality of fasteners located within the first and second attachment apertures and connecting the support blocks to the elongate connector strips and the screening modules to the screening assembly.

9. A screening apparatus according to claim 8, wherein the second end of the rods is arranged in a non-adjustable position at a point above the first end of the rods, said fastener includes an elongate straight shaft and a U-shaped end section, the straight shaft being disposed within the first and second attachment apertures and the U-shaped end section connected about the support frame.

10. A screening apparatus according to claim 8, wherein the elongate support blocks are laterally-extending and comprise an elongate front and rear surface and, when said elongate support blocks are attached to said support frame, the elongate front surface is arranged in a fixed, non-adjustable position at a point above the elongate rear surface, and the second end of the rods is arranged at a point above the first end of the rods, thereby facilitating screening of the particle material.

11. A screening apparatus according to claim 8, wherein said support block further includes a reinforcing member for maintaining the structural integrity of the support block, said reinforcing member defining a plurality of openings which are in vertical alignment with said first and second attachment apertures.

12. A screening apparatus according to claim 8, wherein said fastener includes an elongate straight shaft and a U-shaped end section, the straight shaft being disposed within the first and second attachment apertures and the U-shaped end section connected about the support frame.

13. A screening apparatus according to claim 8, wherein said support members are not located within the flow path of the particulate material during the screening operation.

14. A screening apparatus according to claim 8, wherein a plurality of connecting ties extending across the sieve openings and joined at their respective ends to a pair of adjacent rods for tying together said adjacent rods, the connecting ties and rods together defining a plurality of slots for screening particulate material.

15. A method of producing a finger screen system comprising the steps of:

providing a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

providing a plurality of screening modules, each screening module comprising a support block defining a plurality of first attachment apertures, and a plurality of rods;

joining the first end of said plurality of rods to said support block within said row of first attachment apertures, the second end of the rods being free of attachment to form a row of said rods arranged substantially parallel to each other and extending outwardly from said support block, said row of rods defining an array of continuous sieve openings of a predetermined size for allowing particulate material up to a predetermined size to pass through the screening module, the second end of each rod in each row, when said screening modules are in a stationary position, being arranged in a fixed position at a point above the first end of the rods, thereby facilitating screening of the particulate material; and mounting said attachment assemblies to said horizontally-extending mounting support within said interior screening chamber by directly attaching said screening modules to said elongate connector strip by inserting said fasteners in said first and second attachment apertures and thereby connecting said attachment assemblies to said horizontally-extending mounting support for producing said finger screen system, said screening modules being removable from the screening assembly without the need to detach or disassemble the horizontally-extending support members from the screening assembly.

16. A method according to claim 15, which includes the step of arranging the second end of the rods in a non-adjustable position above the first end of the rods.

17. A method according to claim 15, which includes the steps of providing elongate support blocks which are laterally-extending and include an elongate front and rear surface and, when said elongate support blocks are attached to said support member, arranging the elongate front surface in a fixed, non-adjustable position above the elongate rear surface, and arranging the second end of the rods above the first end of the rods, thereby facilitating screening of the particle material.

18. A method according to claim 15, which further includes the step of providing a reinforcing member within said support block for maintaining the structural integrity of the support block, said reinforcing member defining a plurality of openings which are in vertical alignment with said first and second attachment apertures.

19. A method according to claim 17, which further includes the step of providing a fastener which comprises an elongate straight shaft and a U-shaped end section, the straight shaft being disposed within the first and second attachment apertures and the U-shaped end section connected about the support member.

20. A method according to claim 17, which further includes the step of locating said attachment assemblies outside the flow path of the particulate material.

21. A method according to claim 17, which further includes the step of providing a plurality of connecting ties; extending said connecting ties across the sieve openings; and joining a plurality of said connecting ties at their respective ends to a plurality of adjacent rods thereby tying together said adjacent rods, the connecting ties and rods together defining a plurality of slots for screening particulate material.

22. A method according to claim 17, which further includes the step of removing said screening modules from the screening assembly without the need to detach or disassemble the horizontally-extending support members from the screening assembly by disengaging said fasteners from said first and second attachment apertures and detaching the attachment assemblies from said support members.

23. A finger screening system for screening particulate material comprising:

a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, said support block further including a reinforcing member for maintaining the structural integrity of the support block, said reinforcing member defining a plurality of openings which are in vertical alignment with said first and second attachment apertures, the second end of the rods being free of attachment, to form a row of the rods arranged substantially parallel to each other and extending outwardly from the support block, the row of rods defining an array of sieve openings of a predetermined size for allowing particulate material up to a predetermined size to pass through the screening module;

a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly; and a plurality of fasteners located within the first and second attachment apertures and connecting the support blocks to the elongate connector strips and the screening modules to the screening assembly.

24. A finger screening system for screening particulate material comprising:

a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, the second end of the rods being free of attachment, to form a row of the rods arranged substantially parallel to each other and extending outwardly from the support block, the row of rods defining an array of sieve openings of a predetermined size for allowing particulate material up to a predetermined size to pass through the screening module;

a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly;

a plurality of fasteners located within the first and second attachment apertures and connecting the support blocks to the elongate connector strips and the screening modules to the screening assembly; and said fastener including an elongate straight shaft and a U-shaped end section, the straight shaft being disposed within the first and second attachment apertures and the U-shaped end section connected about the support frame.

25. A finger screening system for screening particulate material comprising:

a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, the second end of the rods being free of attachment, to form a row of the rods arranged substantially parallel to each other and extending outwardly from the support block, the row of rods defining an array of sieve openings of a predetermined size for allowing particulate material up to a predetermined size to pass through the screening module;

a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly;

a plurality of fasteners located within the first and second attachment apertures and connecting the support blocks to the elongate connector strips and the screening modules to the screening assembly; and a plurality of connecting ties extending across the sieve openings and joined at their respective ends to a pair of adjacent rods for tying together said adjacent rods, the connecting ties and rods together defining a plurality of slots for screening particulate material.

26. A finger screening apparatus for use in combination with a screen assembly to form a finger screen system, said screen assembly including a housing defining an interior screening chamber and a horizontally-extending frame located within the confines of said interior screen chamber and joined to the housing for supporting a plurality of screening modules attached to said horizontally-extending frame, said screening assembly having a longitudinally-extending axis and a laterally-extending axis, the finger screening apparatus comprising:

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, said support block further including a reinforcing member for maintaining the structural integrity of the support block, said reinforcing member defining a plurality of openings which are in vertical alignment with said first and second attachment apertures, the second end of the rods being free of attachment, to form a row of the rods arranged substantially parallel to each other and extending outwardly from the support block, the row of rods defining an array of continuous sieve openings of a predetermined size for allowing particulate material up to a predetermined size to pass through the screening module; and a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly; and a plurality of fasteners located within the first and second attachment apertures and connecting the support blocks to the elongate connector strips and the screening modules to the screening assembly.

27. A finger screening apparatus for use in combination with a screen assembly to form a finger screen system, said screen assembly including a housing defining an interior screening chamber and a horizontally-extending frame located within the confines of said interior screen chamber and joined to the housing for supporting a plurality of screening modules attached to said horizontally-extending frame, said screening assembly having a longitudinally-extending axis and a laterally-extending axis, the finger screening apparatus comprising:

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, the second end of the rods being free of attachment, to form a row of the rods arranged substantially parallel to each other and extending outwardly from the support block, the row of rods defining an array of continuous sieve openings of a predetermined size for allowing particulate material up to a predetermined size to pass through the screening module; and a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly;

a plurality of fasteners located within the first and second attachment apertures and connecting the support blocks to the elongate connector strips and the screening modules to the screening assembly; and fastener includes an elongate straight shaft and a U-shaped end section, the straight shaft being disposed within the first and second attachment apertures and the U-shaped end section connected about the support frame.

28. A finger screening apparatus for use in combination with a screen assembly to form a finger screen system, said screen assembly including a housing defining an interior screening chamber and a horizontally-extending frame located within the confines of said interior screen chamber and joined to the housing for supporting a plurality of screening modules attached to said horizontally-extending frame, said screening assembly having a longitudinally-extending axis and a laterally-extending axis, the finger screening apparatus comprising:

a plurality of screening modules mounted for direct attachment to and removal from the screening assembly without the need to detach or disassemble the horizontally-extending support members from the screening assembly, each screening module comprising a support block defining a plurality of first attachment apertures and a plurality of rods joined at a first end to the support block, the second end of the rods being free of attachment, to form a row of the rods arranged substantially parallel to each other and extending outwardly from the support block, the row of rods defining an array of continuous sieve openings of a predetermined size for allowing particulate material up to a predetermined size to pass through the screening module; and a plurality of attachment assemblies for removably joining the plurality of screening modules to the screening assembly, each the attachment assembly comprising an elongate connector strip defining a plurality of second attachment apertures located within the elongate connector strip so that the second attachment apertures are in vertical alignment with the first attachment apertures in the support block thereby allowing a fastener to pass therethrough for connecting the support blocks to the elongate connector strips and in turn attaching the screening modules to the screening assembly;

a plurality of fasteners located within the first and second attachment apertures and connecting the support blocks to the elongate connector strips and the screening modules to the screening assembly, and plurality of connecting ties extending across the sieve openings and joined at their respective ends to a pair of adjacent rods for tying together said adjacent rods, the connecting ties and rods together defining a plurality of slots for screening particulate material.

29. A method of producing a finger screen system comprising the steps of:

providing a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

providing a plurality of screening modules, each screening module comprising a support block defining a plurality of first attachment apertures, and a plurality of rods;

joining the first end of said plurality of rods to said support block within said row of first attachment apertures, the second end of the rods being free of attachment to form a row of said rods arranged substantially parallel to each other and extending outwardly from said support block, said row of rods defining an array of continuous sieve openings of a predetermined size for allowing particulate material up to a predetermined size to pass through the screening module;

mounting said attachment assemblies to said horizontally-extending mounting support within said interior screening chamber by directly attaching said screening modules to said elongate connector strip by inserting said fasteners in said first and second attachment apertures and thereby connecting said attachment assemblies to said horizontally-extending mounting support for producing said finger screen system, said screening modules being removable from the screening assembly without the need to detach or disassemble the horizontally-extending support members from the screening assembly; and providing a reinforcing member within said support block for maintaining the structural integrity of the support block, said reinforcing member defining a plurality of openings which are in vertical alignment with said first and second attachment apertures.

30. A method of producing a finger screen system comprising the steps of:

providing a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

providing a plurality of screening modules, each screening module comprising a support block defining a plurality of first attachment apertures, and a plurality of rods;

providing a fastener which comprises an elongate straight shaft and a U-shaped end section, the straight shaft being disposed within the first and second attachment apertures and the U-shaped end section connected about the support member;

joining the first end of said plurality of rods to said support block within said row of first attachment apertures, the second end of the rods being free of attachment to form a row of said rods arranged substantially parallel to each other and extending outwardly from said support block, said row of rods defining an array of continuous sieve openings of a predetermined size for allowing particulate material up to a predetermined size to pass through the screening module; and mounting said attachment assemblies to said horizontally-extending mounting support within said interior screening chamber by directly attaching said screening modules to said elongate connector strip by inserting said fasteners in said first and second attachment apertures and thereby connecting said attachment assemblies to said horizontally-extending mounting support for producing said finger screen system, said screening modules being removable from the screening assembly without the need to detach or disassemble the horizontally-extending support members from the screening assembly.

31. A method of producing a finger screen system comprising the steps of:

providing a screening assembly including a housing defining an interior screening chamber and a horizontally-extending support members located within the confines of the interior screen chamber and joined to the housing for supporting a plurality of screening modules attached to the horizontally-extending support members, the screening assembly having a longitudinally-extending axis and a laterally-extending axis;

providing a plurality of screening modules, each screening module comprising a support block defining a plurality of first attachment apertures, and a plurality of rods;

joining the first end of said plurality of rods to said support block within said row of first attachment apertures, the second end of the rods being free of attachment to form a row of said rods arranged substantially parallel to each other and extending outwardly from said support block, said row of rods defining an array of continuous sieve openings of a predetermined size for allowing particulate material up to a predetermined size to pass through the screening module;

mounting said attachment assemblies to said horizontally-extending mounting support within said interior screening chamber by directly attaching said screening modules to said elongate connector strip by inserting said fasteners in said first and second attachment apertures and thereby connecting said attachment assemblies to said horizontally-extending mounting support for producing said finger screen system, said screening modules being removable from the screening assembly without the need to detach or disassemble the horizontally-extending support members from the screening assembly; and connecting ties; extending said connecting ties across the sieve openings; and joining a plurality of said connecting ties at their respective ends to a plurality of adjacent rods thereby tying together said adjacent rods, the connecting ties and rods together defining a plurality of slots for screening particulate material.

* * * * *